US006884293B2

(12) United States Patent
Yip

(10) Patent No.: US 6,884,293 B2
(45) Date of Patent: Apr. 26, 2005

(54) SELF-ADJUSTING RETURN LINE AND DIP COATING SOLUTION APPARATUS INCLUDING THE SAME

(75) Inventor: Man Kit Yip, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/247,835

(22) Filed: Sep. 19, 2002

(65) Prior Publication Data

US 2004/0055535 A1 Mar. 25, 2004

(51) Int. Cl.[7] ..... B05C 11/00
(52) U.S. Cl. ..... 118/612; 118/429
(58) Field of Search ..... 137/433, 426, 137/615; 73/322.5; 118/602, 612, 429, 423; 138/119–122

(56) References Cited

U.S. PATENT DOCUMENTS 1,010,562 A * 12/1911 Woodward
3,351,083 A * 11/1967 Sait
3,421,477 A * 1/1969 Gilbert et al.
4,342,328 A * 8/1982 Matta

FOREIGN PATENT DOCUMENTS

JP 57104041 6/1982

OTHER PUBLICATIONS 2 pages of hard–copy print–out of NewAge Industries "home page", whose web address is http://plastics.newage-industries.com, dated Sep. 18, 2002.

3 pages of hard–copy print–out of NewAge Industries "products", "Corrugated FEP Tubing" section, whose web address is http://plastics.newageindustries.com/corrtef.asp, dated Sep. 18, 2002.

* cited by examiner

*Primary Examiner*—Brenda A. Lamb
(74) *Attorney, Agent, or Firm*—Wayne J. Egan

(57) ABSTRACT

A diptank applies coating solution to devices that are dipped therein. A reservoir tank contains a reservoir of coating solution. The diptank forms a coating solution overflow return that flows to the reservoir by means of a conduit and a self-adjusting return line. The self-adjusting return line comprises a plastic tubing with an upper portion, a central portion and a lower portion. The upper portion is coupled to the conduit. The tubing central portion is flexible and corrugated and arranged to extend and compress in its length. The lower portion is supported by an attached buoy that floats on the surface of the reservoir. The lower portion defines an outlet that discharges the coating solution overflow return to the reservoir. As a result, the coating solution overflow return is discharged to the reservoir at a fixed vertical distance or level with respect to the surface of the reservoir.

7 Claims, 3 Drawing Sheets

SELF-ADJUSTING RETURN LINE AND DIP COATING SOLUTION APPARATUS INCLUDING THE SAME

BACKGROUND OF THE INVENTION

It is known to use diptanks to apply photoreceptor coating solution to photoreceptor devices. Once inserted in the diptanks, the devices will be removed from the diptank with a controlled speed, and a thin layer of photoreceptor coating becomes coated upon each device.

Typically the diptank will create a coating solution overflow return that flows to a reservoir by means of a return line. Later, this returned coating solution in the reservoir will be filtered and pumped back to the diptank.

The typical return line discharges the coating solution overflow return into the reservoir at a fixed vertical height or level with respect the surface of the reservoir. This fixed-height discharge approach creates problems. If the solution overflow return discharge level is set too low with respect to the surface of the reservoir such as, for example, when the solution overflow return discharge is near the reservoir tank bottom, the discharged solution will not mix well. On the other hand, if the solution overflow return discharge level is set too high with respect to the surface of the reservoir such as, for example, when the solution overflow return discharge is a substantial height above the surface, then the solution overflow return discharge will spread on the surface of the surface of the reservoir and create bubbles. These bubbles are not desired, as they will create coating defects in the finished photoreceptor devices.

In another aspect of the invention, there is described a self-adjusting return line for use with a diptank for applying coating solution to devices that are dipped therein and a reservoir tank containing a reservoir of coating solution, the diptank forming a coating solution overflow return that flows to the coating solution reservoir by means of a conduit and the self-adjusting return line, the self-adjusting return line comprising a tubing that includes an upper portion, a central portion and a lower portion, the upper portion coupled to the conduit, the central portion arranged to extend and compress in its length, the lower portion supported by an attached buoy that floats on a surface of the reservoir, the lower portion defining an outlet for discharging the coating solution overflow return to the reservoir.

DETAILED DESCRIPTION OF THE INVENTION

Briefly, a diptank applies coating solution to devices that are dipped therein. A reservoir tank contains a reservoir of coating solution. The diptank forms a coating solution overflow return that flows to the reservoir by means of a conduit and a self-adjusting return line. The self-adjusting return line comprises a plastic tubing with an upper portion, a central portion and a lower portion. The upper portion is coupled to the conduit. The tubing central portion is flexible and corrugated and arranged to extend and compress in its length. The lower portion is supported by an attached buoy that floats on the surface of the reservoir. The lower portion defines an outlet that discharges the coating solution overflow return to the reservoir. As a result, the coating solution overflow return is discharged to the reservoir at a fixed vertical distance or level with respect to the surface of the reservoir.

Figure 1:
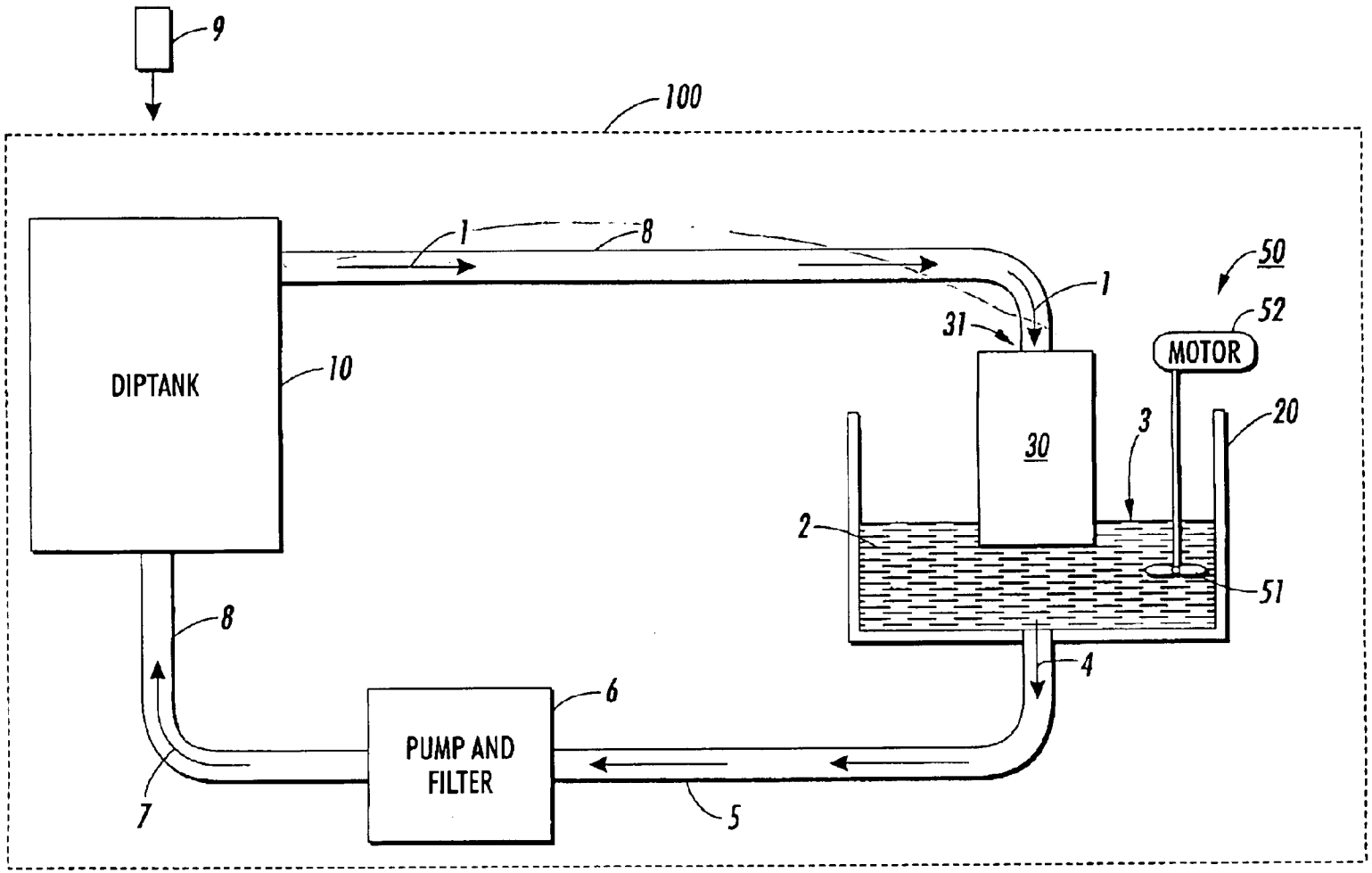
FIG. 1 depicts an apparatus 100 comprising a diptank 10 for applying coating solution to devices 9 that are dipped therein together with a reservoir tank 20 containing a reservoir 2 of coating solution. As depicted, the diptank 10 forms a coating solution overflow return 1 that flows to the reservoir 2 by means of a conduit 8 and a first embodiment of a self-adjusting return line 30, in accordance with the present invention.

Referring now to FIG. 1, there is depicted apparatus 100 comprising a diptank 10 for applying coating solution to devices 9 that are dipped therein and a reservoir tank 20 containing a reservoir 2 of coating solution. As depicted, the diptank 10 forms a coating solution overflow return 1 that flows to the reservoir 2 by means of a conduit 8 and a first embodiment of a self-adjusting return line 30, in accordance with the present invention. In one embodiment, the conduit 8 comprises a stainless steel piping.

In one embodiment, the devices 9 comprise photoreceptor devices and the coating solution comprises a photoreceptor coating solution.

As depicted in FIG. 1, in one embodiment, the reservoir tank 20 is arranged with a mixer 40 comprising mixing blades 51, the blades 51 arranged to be immersed in the reservoir 2 of coating solution and to rotate and thereby circulate or mix the coating solution, the mixing blades 51 being driven by an included motor 52.

As further depicted in FIG. 1, the returned coating solution in the reservoir 2 is filtered and pumped back to the diptank 10 by means of the depicted pump and filter 6 and the conduits 5 and 8. The FIG. 1 reference number 4 depicts the coating solution flow from the reservoir 2 to the pump and filter 6 by means of the conduit 5. The FIG. 1 reference number 7 depicts the coating solution flow from the pump and filter 6 to the diptank 10 by means of the conduit 8. In one embodiment, the conduits 5 and 8 comprise a stainless steel piping.

Figure 2:
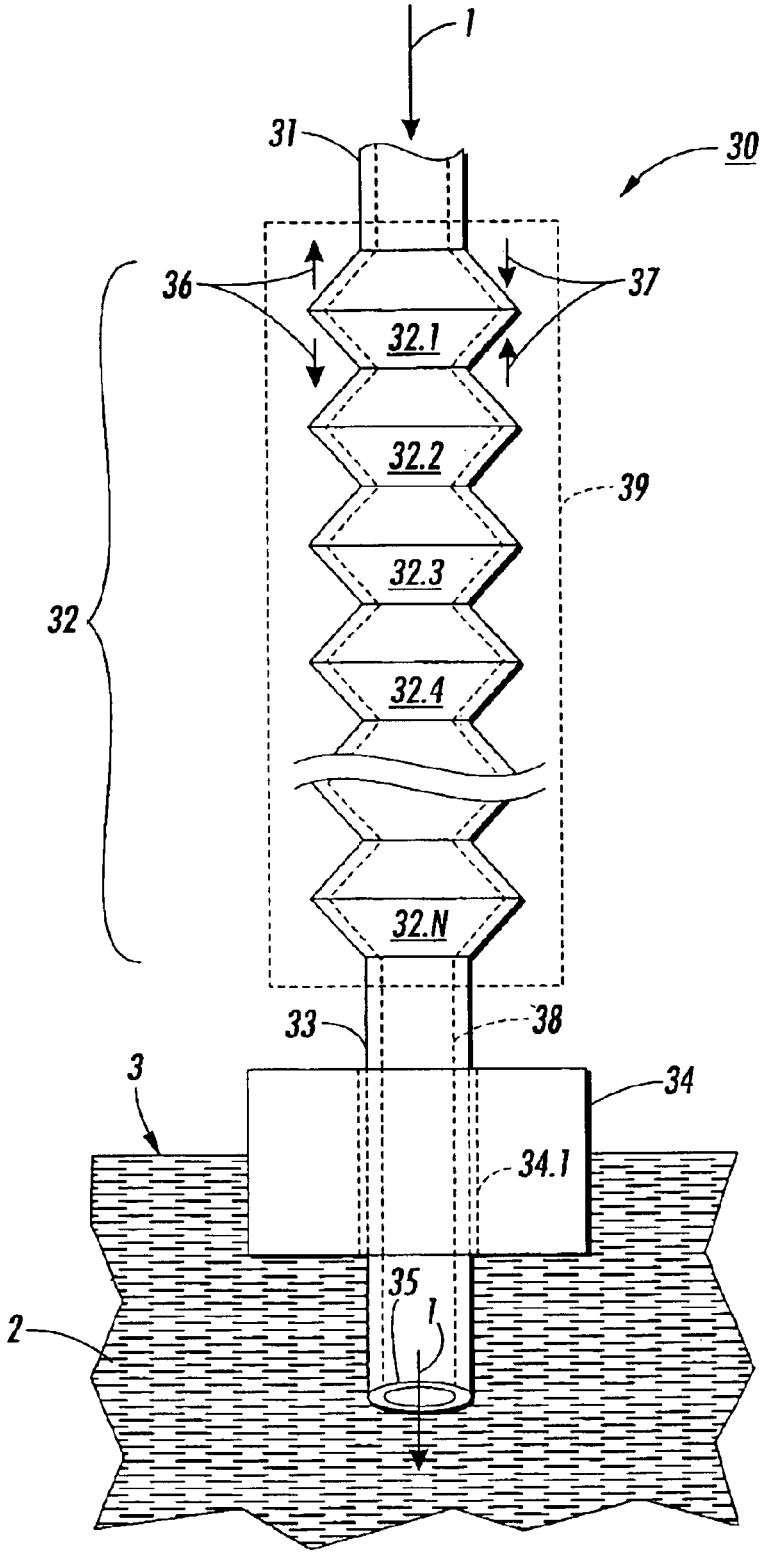
FIG. 2 depicts further detail of the FIG. 1 self-adjusting return line 30. As depicted, the self-adjusting return line 30 includes a buoy 34.

Referring now to FIG. 2 there is depicted the self-adjusting return line 30. As depicted, the self-adjusting return line 30 comprises a hollow tubing 31-32-33 with a circular cross-section. The hollow tubing 31-32-33 contains an inner channel 38.

As depicted in FIGS. 1–2, the coating solution overflow return 1 flows from the conduit 8 through the tubing 31-32-33-provided channel 38 to the reservoir 2.

As depicted in FIG. 2, the tubing 31-32-33 includes an upper portion 31, a central portion 32 and a lower portion 33. The upper portion 31 coupled to the conduit 8. This latter coupling of the upper portion 31 to the conduit 8 is depicted in the prior FIG. 1. Still referring to FIG. 2, the central portion 32 arranged to extend 36 and compress 37 in length.

In one embodiment, the tubing central portion 32 is comprised of flexible and corrugated teflon or FEP plastic tubing with a plurality (N) of interconnected individual tubing sections depicted in FIG. 2 by reference numbers 32.1, 32.2, 32.3, 32.4, . . . , 32.N. In turn, each individual tubing section 32.1 through 32.N is arranged to extend, expand or increase in its length, as depicted in FIG. 2 by reference number 36, and compress, collapse or decrease in its length, as depicted in FIG. 2 by reference number 37. It will be understood that the individual tubing sections 32.1 through 32.N expand and contract in a manner similar to the operation of the familiar accordion-type musical instrument.

In one embodiment, the plastic tubing 31-32-33 is similar or equivalent to the plastic tubing products provided by the vendor NewAge Industries, Inc., whose mailing address is 145 James Way, Southampton, Pa. 18966, whose phone number 215-526-2300, and whose internet web address is http://plastics.newageindustries.com.

As depicted in FIG. 2, the tubing lower portion 33 is supported by an attached buoy 34. In turn, the buoy 34 floats on a surface 3 of the reservoir 2.

Figure 3A:
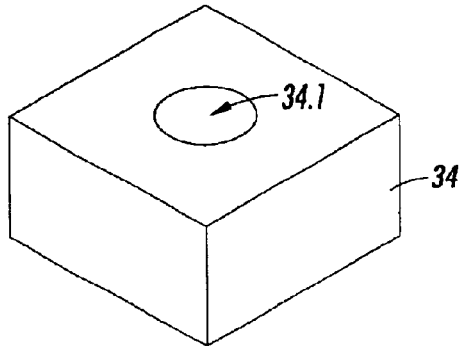
FIGS. 3A–3C depict various embodiments of the buoy 34.
Figure 3B:
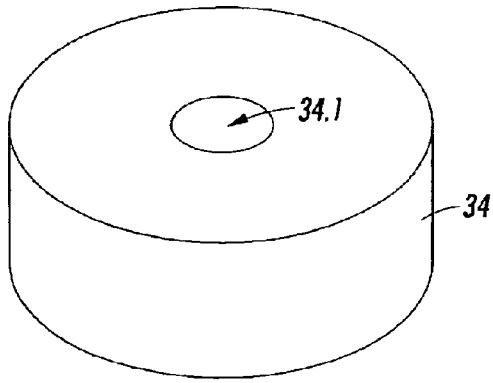
Figure 3C:
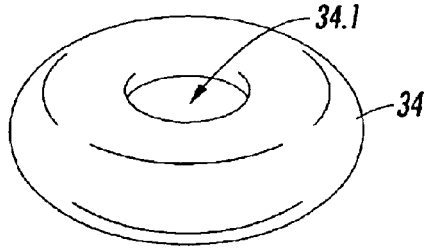

In one embodiment, the buoy 34 is comprised of polystyrene foam formed of a suitable size and shape containing an integral hole, channel or opening 34.1 of suitable size, shape and position through which hole, channel or opening 34.1 the tubing lower portion 33 is inserted and secured by means of friction, glue, adhesive or other suitable fastening device. In one embodiment, the buoy 34 is shaped like a cube, rectangular box or like parallelepiped object, as depicted in FIG. 3A. In another embodiment, the buoy 34 is shaped like a circular plate or disk, as depicted in FIG. 3B. In a further embodiment, the buoy 34 is shaped like a doughnut, ring, toroid, or other annular object, as depicted in FIG. 3C.

Still referring to FIG. 2, the tubing lower portion 33 defines an outlet 35. In turn, the outlet 35 discharges the coating solution overflow return 1 to the reservoir 2.

Based on the tubing central portion 32 being arranged to extend and compress in its length and further based on the tubing lower portion 33 being supported by the attached buoy 34 that floats on the surface 3 of the reservoir 2, the tubing lower portion 33 outlet 35 thereby discharges the coating solution overflow return 1 to the reservoir 2 at a substantially fixed vertical distance or level with respect to the surface 3. Thus, as the surface 3 ascends or moves upwards in response to adding coating solution to the reservoir 2, the outlet 35 (which outlet 35 discharges the coating solution overflow return 1 to the reservoir 2) also ascends or move upwards substantially in unison with the surface 3. Likewise, as the surface 3 descends or moves downwards in response to removing coating solution from the reservoir 2, the outlet 35 (which outlet 35 discharges the coating solution overflow return 1 to the reservoir 2) also descends or move downwards substantially in unison with the surface 3. As a result, the tubing lower portion 33 outlet 35 discharges the coating solution overflow return 1 to the reservoir 2 at a substantially fixed vertical distance or level with respect to the surface 3.

As depicted in FIG. 2, in one embodiment, the self-adjusting return line 30 includes a substantially open shell 39 arranged to surround and support the central portion 32 to keep the central portion 32 in a substantially vertical position. In one embodiment, the shell 39 is comprised of stainless steel.

Thus, referring generally to FIGS. 1–2, there is described apparatus 100 comprising a diptank 10 for applying coating solution to devices 9 that are dipped therein and a reservoir tank 20 containing a reservoir 2 of coating solution, the diptank 10 forming a coating solution overflow return 1 that flows to the reservoir 2 by means of a conduit 8 and a self-adjusting return line 30, the self-adjusting return line 30 comprising a tubing 31-32-33 that includes an upper portion 31, a central portion 32 and a lower portion 33, the upper portion 31 coupled to the conduit 8, the central portion 32 arranged to extend and compress in its length, the tubing lower portion 33 supported by an attached buoy 34 that floats on a surface 3 of the reservoir 2, the tubing lower portion 33 defining an outlet 35 for discharging the coating solution overflow return 1 to the reservoir 2.

Further, referring generally to FIGS. 1–2, there is described a self-adjusting return line 30 for use with a diptank 10 for applying coating solution to devices 9 that are dipped therein and a reservoir tank 20 containing a reservoir 2 of coating solution, the diptank 10 forming a coating solution overflow return 1 that flows to the coating solution reservoir 2 by means of a conduit 8 and the self-adjusting return line 30, the self-adjusting return line 30 comprising a tubing 31-32-33 that includes an upper portion 31, a central portion 32 and a lower portion 33, the upper portion 31 coupled to the conduit 8, the central portion 32 arranged to extend 36 and compress 37, the tubing lower portion 33 supported by an attached buoy 34 that floats on a surface 3 of the reservoir 2, the tubing lower portion 33 defining an outlet 35 for discharging the coating solution overflow return 1 to the reservoir 2.

While various embodiments of a self-adjusting return line and dip coating solution apparatus including the same, in accordance with the present invention, have been described hereinabove, the scope of the invention is defined by the following claims.

What is claimed is:

1. Apparatus comprising a diptank for applying photoreceptor coating solution to photoreceptor devices that are dipped therein and a reservoir tank containing a reservoir of photoreceptor coating solution, the diptank forming a photoreceptor coating solution overflow return that flows from the diptank to the reservoir by means of a conduit and a self-adjusting return line, the self-adjusting return line comprising a tubing that includes an upper tubing portion, a flexible-length central tubing portion and a lower tubing portion, the upper tubing portion coupled to the conduit, the flexible-length central tubing portion arranged to extend and compress in its length, the lower tubing portion supported by an attached buoy that floats on a surface of the reservoir of photoreceptor coating solution, the lower tubing portion defining an outlet for discharging the photoreceptor coating solution overflow return into the reservoir of photoreceptor coating solution, wherein the buoy contains an integral hole, channel or opening through which the lower tubing portion is inserted and secured such that the flexible-length central tubing portion is positioned above the surface and the outlet is positioned at a substantially fixed vertical distance below the surface so that the photoreceptor coating solution overflow return is discharged in a downwards direction into the reservoir at a fixed vertical distance or level below the surface of the reservoir, wherein the flexible-length central tubing portion comprises a plurality of interconnected individual tubing sections, each individual tubing section being arranged to extend and compress.

2. The apparatus of claim 1, the flexible-length central tubing portion is comprised of flexible and corrugated teflon or FEP plastic tubing.

3. The apparatus of claim 2, the buoy is comprised of polystyrene foam.

4. The apparatus of claim 1, the buoy having a shape of any one of a cube, rectangular box, circular plate, circular disk, doughnut, ring and toroid.

5. The apparatus of claim 1, the reservoir tank arranged with a mixer comprising mixing blades, the blades arranged to be immersed in the reservoir of coating solution and to rotate and thereby circulate or mix the photoreceptor coating solution.

6. The apparatus of claim 1, the self-adjusting return line including a substantially open shell arranged to surround and support the flexible-length central tubing portion to keep the flexible-length central tubing portion in a substantially vertical position.

7. The apparatus of claim 6, the shell is comprised of stainless steel.

* * * * *